United States Patent [19]

Demers

[11] Patent Number: 4,977,637

[45] Date of Patent: Dec. 18, 1990

[54] MAGNETIC WINDOW CLEANING APPARATUS

[76] Inventor: Rodney C. Demers, 317 7th St. E., Bradenton, Fla. 34208

[21] Appl. No.: 480,846

[22] Filed: Feb. 16, 1990

[51] Int. Cl.[5] ..... A47L 1/08

[52] U.S. Cl. ..... 15/104 R; 15/220 A; 15/245

[58] Field of Search ..... 15/220 A, 103, 104, 15/245, 250.11

[56] References Cited

U.S. PATENT DOCUMENTS

| | | | |
|---|---|---|---|
| 3,296,645 | 1/1967 | Shore | 15/220 A |
| 3,600,737 | 8/1971 | Shore | 15/220 A X |
| 3,759,621 | 9/1973 | DeCarlo | 15/220 A X |
| 3,922,747 | 12/1975 | Kaftan | 15/220 A |
| 3,983,591 | 10/1976 | Ohtaki et al. | 15/220 A X |
| 4,144,091 | 3/1979 | Tran | 15/220 A X |

*Primary Examiner*—Chris K. Moore

*Attorney, Agent, or Firm*—Charles J. Prescott

[57] ABSTRACT

Inside and outside window surface cleaning units contain magnets disposed adjacent to respective base walls. All magnets of the inside unit have the same polarity surfaces adjacent to the base wall. All magnets of the outside unit have all magnets with the opposite polarity adjacent to the base wall so that lateral displacement of the inner and outer units does not cause magnetic repulsion, but rather sustains attraction. A separate outside squeegee unit is provided also having magnets of the opposite polarity adjacent to the base wall.

8 Claims, 3 Drawing Sheets

MAGNETIC WINDOW CLEANING APPARATUS

BACKGROUND OF THE INVENTION

1. Field of the Invention

This invention relates generally to window cleaning apparatus, and more particularly to inner and outer window surface cleaning units which are magnetically attracted to each other.

2. Description of Related Art

A number of patentees have recognized the desirability of simultaneously cleaning the inside and outside surfaces of glass using magnetically attracted units.

U.S. Pat. No. 3,296,645, Shore, entitled: "Apparatus for Cleaning Windows", discloses the use of cleaning units which each have adjacent magnets of alternating polarity.

U.S. Pat. No. 3,492,685, Curzon, entitled: "Window Washing Device", discloses the use of horseshoe magnets for holding the cleaning units.

U.S. Pat. No. 3,600,737, Shore, entitled: "Apparatus for Cleaning Windows", discloses the use of cleaning units having angularly disposed halves.

U.S. Pat. No. 3,609,793, Kaftan, entitled: "Magnetic Window Cleaning Apparatus", discloses the use of a magnetic member to hold a cleaning sheet in position on each unit.

U.S. Pat. No. 3,731,337, Doyel, entitled: "Magnetic Window Cleaning Device", discloses the use of annular magnets in frames having a leading edge adjacent to the window surface and a trailing edge spaced therefrom.

U.S. Pat. No. 3,759,621, De Carlo, entitled: "Window Cleaning Apparatus", discloses magnetic units including reservoirs for window cleaning fluid.

U.S. Pat. No. 3,922,747, Kaftan, entitled: "Magnetic Window Cleaning Apparatus with Improved Cleaning Material", discloses the use of an absorbent paper having polyethylene chips embedded thereon for use on the cleaning units.

U.S. Pat. No. 3,983,591, Ohtaki et al., entitled: "Cleaning Device", discloses the use of a brush on the cleaning units.

U.S. Pat. No. 4,144,091, Tran, entitled: "Window Wipe", discloses a container on the outside cleaning unit having compartments for cleaning elements.

None of the foregoing patents disclose the use of laterally spaced adjacent magnets having like poles rather than poles of alternating polarity, and none discloses a separate outside squeegee unit.

SUMMARY OF THE INVENTION

The present invention has a manually movable window inside surface cleaning unit which has a plurality of laterally spaced magnets disposed therein adjacent to the cleaning surface. Each of the magnets has a pole of like polarity, e.g. north pole, adjacent to the cleaning surface. The outer surface unit also has a plurality of laterally spaced magnets disposed therein adjacent to the cleaning surface. The outer unit magnets have a pole of opposite polarity to that of the inside unit, i.e. south pole, adjacent to the cleaning surface. With this arrangement of magnets, a lateral displacement between the inner and outer units still maintains attraction between the two; whereas if the magnets in each unit were of alternating polarity, repulsion or lose of attraction would result from lateral displacement. In addition to the window outside surface cleaning unit, an outside squeegee unit is provided.

It is therefore an object of this invention to provide a magnetic window cleaning apparatus which will maintain attraction even when the inside and outside units become laterally displaced.

It is also an object of this invention to provide a magnetic window cleaning apparatus having separate outside surface cleaning and squeegeeing units.

In accordance with these and other objects, which will become apparent hereafter, the instant invention will now be described with reference to the accompanying drawings.

DETAILED DESCRIPTION OF THE INVENTION

Figure 1:
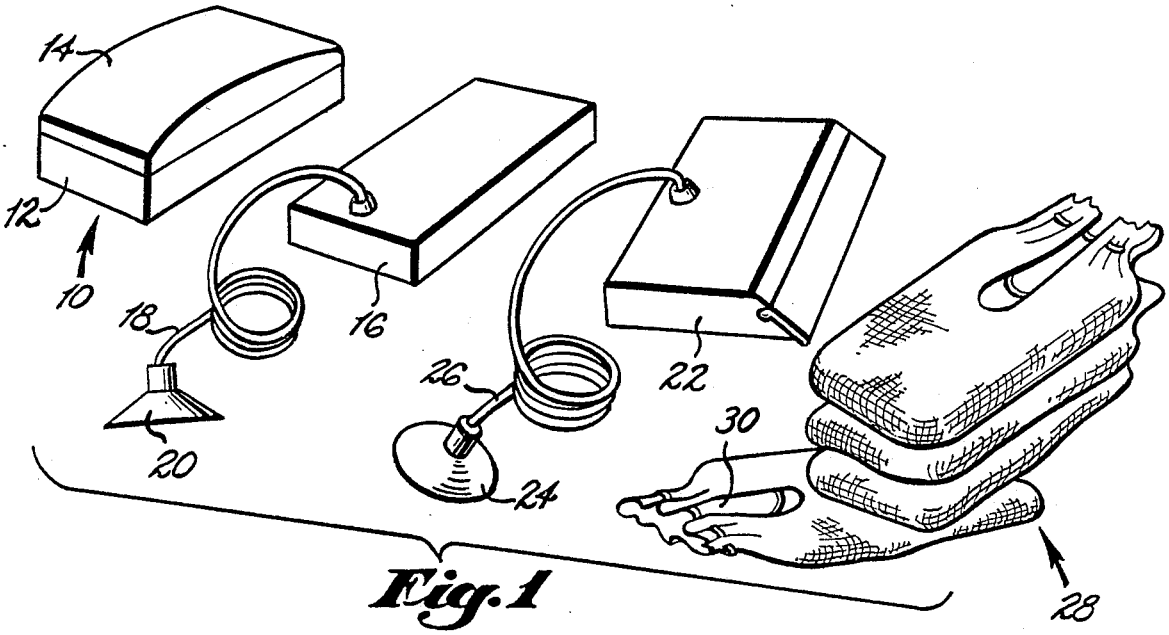
FIG. 1 is an exploded perspective view of the components of the invention.

Referring to FIG. 1, manually movable window inside surface unit 10 is shown as having a rectilinear base element 12 and a hand grip 14. Also shown is magnetically movable window outside surface cleaning unit 16 having secured thereto by line 18 a suction cup 20. In addition, magnetically movable window outside surface squeegee unit 22 also has suction cup 24 secured thereto by line 26. Finally, a plurality of cleaning bags 28 having an open end and a slot, such as slot 30, extending therefrom.

Figure 2:
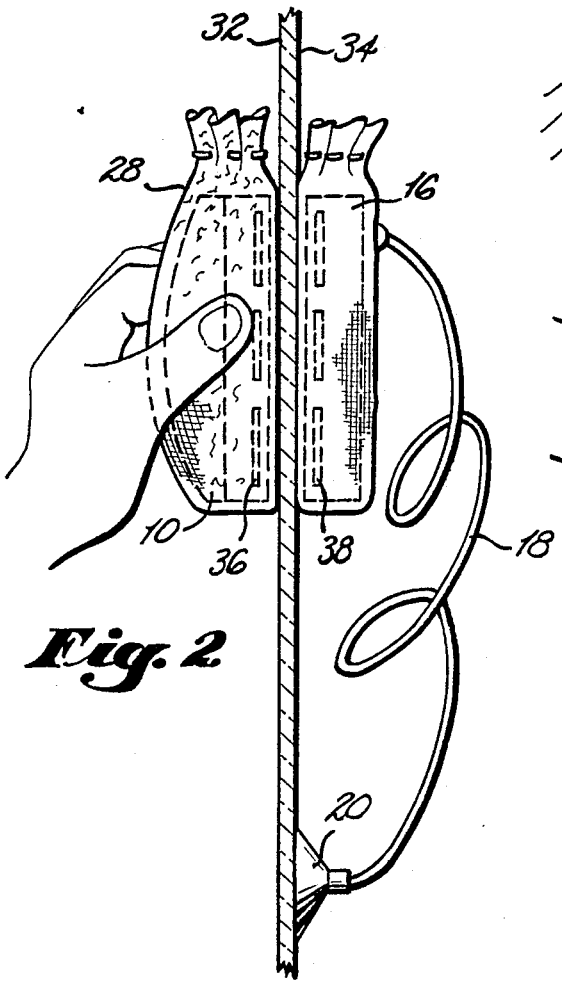
FIG. 2 is a side elevation, partially in cross-section, showing the invention being used in cleaning the inside and outside surfaces of a window.

Turning to FIG. 2, a window having inside surface 32 and outside surface 34 is shown in cross-section. Manually movable inside surface cleaning unit 10 is in position on window inside surface 32 and is contained in a cleaning bag 28. The opening of bag 28 is shown to have gathered edges to aid in keeping it on the cleaning unit. Contained in the base element are permanent magnets such as magnet 36. Magnetically movable window outside surface cleaning unit 16 is in position on window outside surface 34 opposite inside surface cleaning unit 10. Outside surface cleaning unit 16 is also contained in a cleaning bag 28 and has contained within its body magnets, such as magnet 38. Suction cup 20 is adhered to window outside surface 34. In use, suction cup 20 is initially placed in position on window outside surface 34, with outside surface cleaning unit 16 suspended thereby adjacent to the window and contained in a cleaning bag saturated with a cleaning solution. The user then positions inside surface cleaning unit 10—similarly having a bag saturated with cleaning solution—on window inside surface 32 opposite outside surface unit 16 so that magnetic attraction occurs. Then, inside surface cleaning unit is moved about window inside surface 32 to clean it, while outside surface unit 16 is magnetically moved correspondingly, cleaning window outside surface 36. Bags 28 may be formed of any conventional cleaning material, such as paper or cloth, and may have nylon mesh reinforcement.

Figure 3:
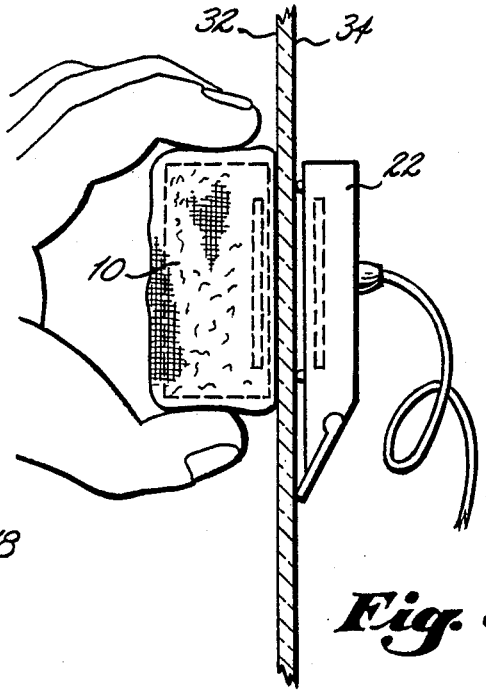
FIG. 3 is a side elevation, partially in cross-section, showing the invention being used to squeegee the outside surface of a window.
Figure 4:
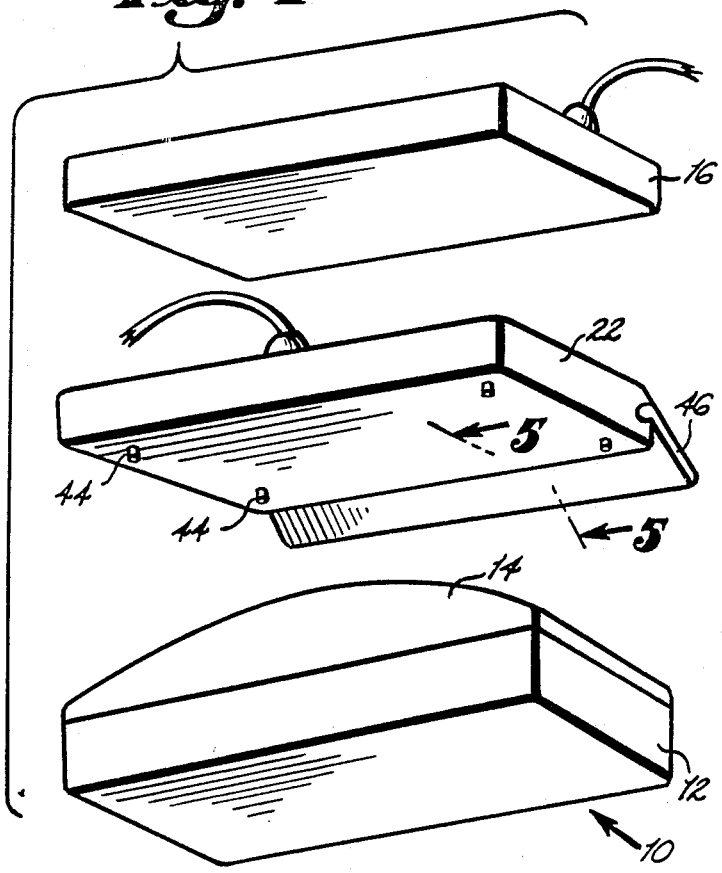
FIG. 4 is an exploded view showing the three basic components of the invention from a viewpoint below.

Turning to FIG. 3, when cleaning is completed, squeegee unit 22 is positioned on window outside surface 34 using suction cup 24. Window inside surface 32 is dried using a separate squeegee, paper towel, etc. Then inside cleaning unit 10—with a new bag 28, or bag 28 removed—is positioned opposite squeegee unit 22. Squeegee unit 22 is then maneuvered to dry window outside surface 34 using inside cleaning unit 10 to move it.

Figure 5:
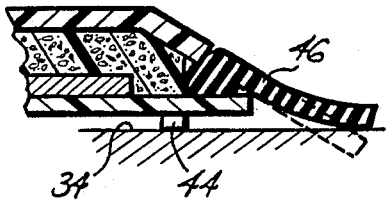
FIG. 5 is a cross-section taken on the line 5—5 of FIG. 4.
Figure 6:
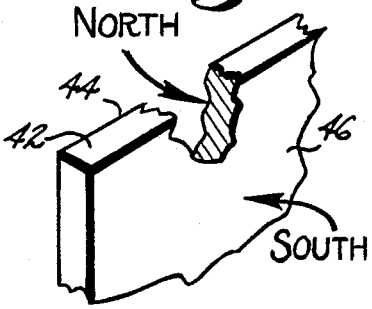
FIG. 6 is a detail of a magnet used in the invention partially in cross-section.
Figure 7:
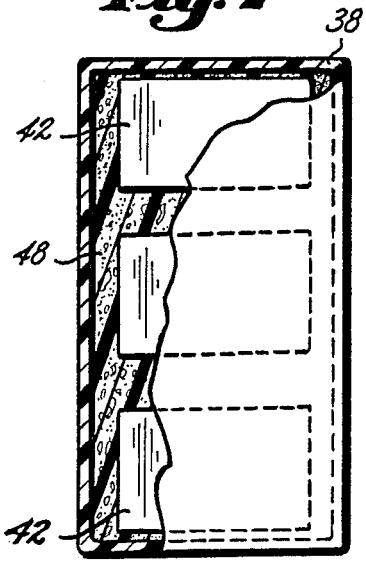
FIG. 7 is a plan view, partially in cross-section, of a magnetic unit in accordance with the invention.
Figure 8:
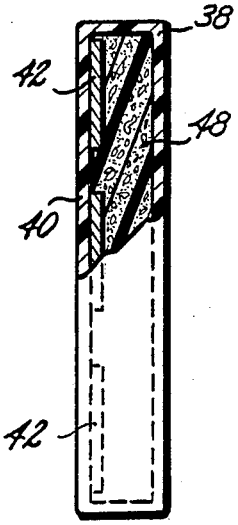
FIG. 8 is a side elevation, partially in cross-section, of the unit of FIG. 7.
Figure 9:
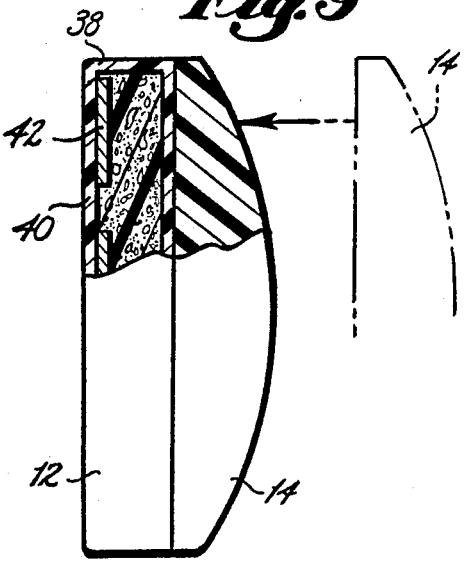
FIG. 9 is a side elevation, partially in cross-section, of a magnetic unit in accordance with the invention showing the hand grip separated in partial phantom view.

Turning now to FIGS. 4 through 9, the structure of units 10, 16 and 22 will be described in more detail. Each of these units has a rectilinear construction, with unit 10 having in addition handle portion 14. Handle portion 14 may be formed of plastic and is secured, as by adhesive, to base 12. Base 12 and units 16 and 22 have a substantially rigid, plastic housing 38 which can be formed as two halves, or a bottom with a top, which are secured together in any desirable manner, such as by adhesive. Positioned within housing 38, adjacent to housing base wall 40, are a plurality of magnets 42. As shown in FIG. 6, each magnet 42 has opposed surface areas 44 and 46 which have opposite magnetic polarities—north and south. Each magnet within base 12 of inside cleaning unit 10 has the same pole—say the north pole—positioned adjacent to the base wall 40 and the opposite, or south pole, facing inwardly. Each magnet within units 16 and 22 is oppositely disposed, i.e. with the south pole adjacent to the base wall 40 and the north pole facing inwardly. As shown, all of the magnets are laterally spaced. Magnets 42 may be initially held in position using adhesive. Plastic 48 is then foamed in place and the housing sealed together. Squeegee unit 22 is also seen to have a plurality of short legs 44 so that the body of squeegee unit 22 will be spaced slightly from the outside window surface. Squeegee 46 is shown in FIG. 5 to be disposed at an angle such that it will be biased against outside window surface 34 when legs 44 are against outside window surface 34.

Figure 10:
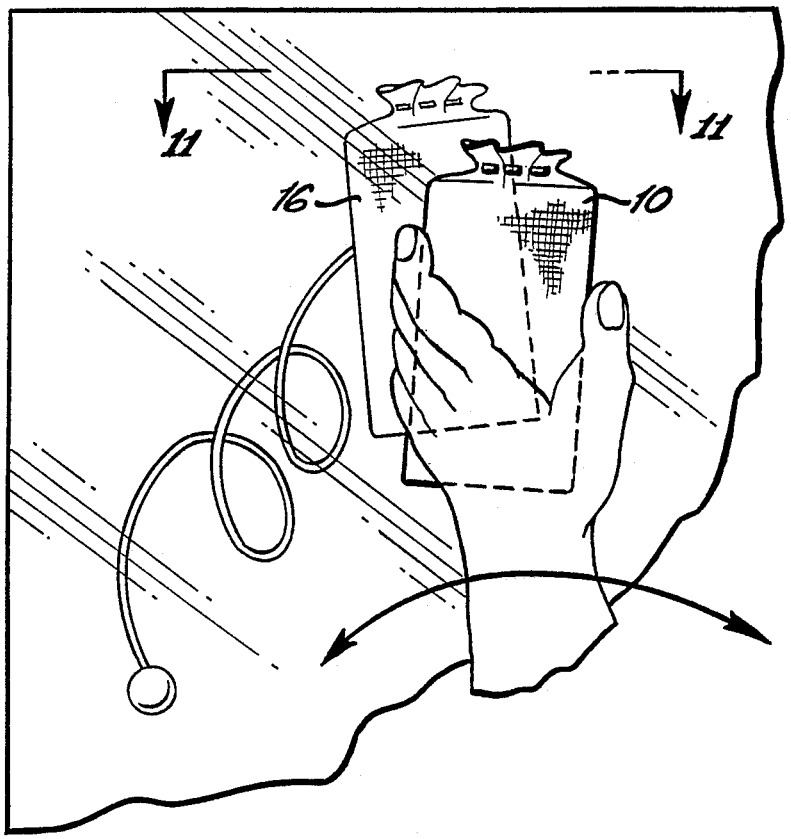
FIG. 10 is a front elevation of the invention in use showing partial lateral displacement between the inside and outside units.
Figure 11:
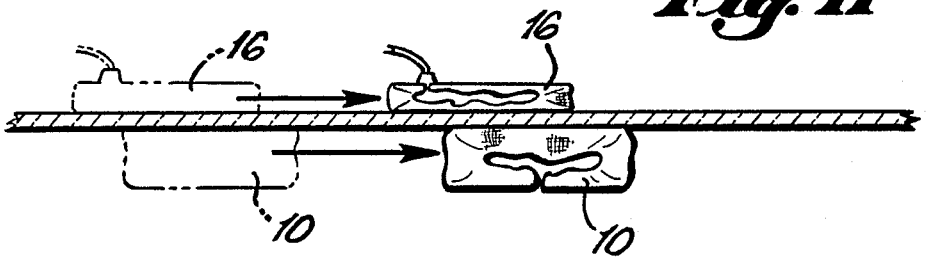
FIG. 11 is a plan view, partially in cross-section, taken on the line 11—11 of FIG. 10.

As depicted in FIGS. 10 and 11, an important feature of this invention derives from the disposition of magnets 42 as described above. Each magnet within inside unit 10 is attracted to each magnet within unit 16 when they are in position for use. Because of this, even though the inside unit and the outside unit become laterally displaced during use, magnetic attraction will be maintained. If alternate magnets were oppositely poled—as shown in the prior art—magnetic repulsion will occur with lateral displacement. Such lateral displacement typically occurs when rapid movements or changes in direction happen.

While the instant invention has been shown and described herein in what is conceived to be the most practical and preferred embodiment, it is recognized that departures may be made therefrom within the scope of the invention, which is therefore not to be limited to the details disclosed herein, but is to be afforded the full scope of the claims so as to embrace any and all equivalent apparatus and articles.

I claim:

1. Magnetic window cleaning apparatus for simultaneously cleaning the inner and outer surfaces of a window comprising:

a plurality of rectilinear magnets having opposed surface areas and opposed edges;

said opposed surface areas being substantially larger than said opposed edges;

one of said opposed surface areas on each said magnet having one polarity and the other of said opposed surface areas having the other polarity;

a manually movable window inside surface unit having a rectilinear base including a base wall with an outer base surface;

a first plurality of said rectilinear magnets disposed in said inside surface unit adjacent to said base wall;

each of said magnets in said first plurality having said one polarity surface area adjacent to said base wall of said inside surface unit;

a magnetically movable rectilinear window outside surface unit having a base wall with an outer base surface;

a second plurality of said rectilinear magnets disposed in said outside surface unit adjacent to said base wall;

each of said magnets in said second plurality having said other polarity surface area adjacent to said base wall of said outside surface unit.

2. Magnetic window cleaning apparatus in accordance claim 1 wherein: said rectilinear base of said window inside surface unit and said outside surface unit have substantially rigid plastic housings;

said rigid plastic housings contain foamed in place plastic.

3. Magnetic window cleaning apparatus in accordance claim 1 wherein:

said rectilinear window outside surface unit has a suction cup attached thereto by a line.

4. Magnetic window cleaning apparatus in accordance claim 1 further including:

a magnetically movable rectilinear window outside surface squeegee unit having a base wall with an outer base surface;

a third plurality of said rectilinear magnets disposed in said outside surface squeegee unit adjacent to said base wall;

each of said magnets in said third plurality having said other polarity surface area adjacent to said base wall of said outside surface squeegee unit.

5. Magnetic window cleaning apparatus in accordance claim 4 wherein:

said outside surface squeegee unit has a squeegee mounted along one edge directed angularly downwardly with respect to said base wall.

6. Magnetic window cleaning apparatus in accordance claim 4 further including:

a plurality of legs extending outwardly from said base wall of said outside surface squeegee unit.

7. Magnetic window cleaning apparatus for simultaneously cleaning the inner and outer surfaces of a window comprising:

an inside window surface unit and an outside window surface unit; each of said units having a housing including a base wall; said inside window surface unit having at least two laterally spaced magnets disposed adjacent to said base wall of said inside window surface unit and having one polarity surface closest to said base wall;

said outside window surface unit having at least two laterally spaced magnets disposed adjacent to said base wall of said outside window surface unit and having another polarity surface closest to said base wall.

8. Magnetic window cleaning apparatus for cleaning the inner and outer surfaces of a window comprising:

an inside window surface cleaning unit, an outside window surface cleaning unit and an outside window squeegee unit;

each of said outside units having a magnet disposed adjacent to a base wall;

said outside window surface squeegee unit having a squeegee mounted along one edge directed angularly downwardly with respect to said squeegee base wall;

a plurality of legs extending outwardly from said base wall of said outside surface squeegee unit.

* * * * *